US006424813B1

(12) United States Patent
Hatakeyama

(10) Patent No.: US 6,424,813 B1
(45) Date of Patent: Jul. 23, 2002

(54) IMAGE FORMING APPARATUS HAVING A DEVELOPING ROLLER AND A DEVELOPING DEVICE TO MINIMIZE IMAGE CARRIER WEAR

(75) Inventor: Takashi Hatakeyama, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/662,467

(22) Filed: Sep. 15, 2000

(51) Int. Cl.[7] ..... G03G 15/08
(52) U.S. Cl. ..... 399/279; 399/286
(58) Field of Search ..... 399/186, 279, 399/286, 164

(56) References Cited

U.S. PATENT DOCUMENTS 6,185,393 B1 * 2/2001 Karakama et al. ..... 399/103

FOREIGN PATENT DOCUMENTS

JP 6-348182 12/1994

* cited by examiner

*Primary Examiner*—Quana M. Grainger
(74) *Attorney, Agent, or Firm*—Foley & Lardner

(57) ABSTRACT

A developing roller according to the invention has an outer circumferential surface, which can be set in frictional contact with a photosensitive belt that is stretched to be driven in a prescribed direction. The outer surface is divided into two mirror surfaces and a rough surface. The mirror surfaces are provided on the end portions of the roller, they do not retain developer. The rough surface extends between the mirror surfaces, for retaining developer. Spacer means prevents the photosensitive belt from coming into frictional contact with the mirror surfaces. The mirror surfaces are therefore prevented from scraping the photosensitive belt. This prolongs the lifetime of the photosensitive belt.

11 Claims, 5 Drawing Sheets

IMAGE FORMING APPARATUS HAVING A DEVELOPING ROLLER AND A DEVELOPING DEVICE TO MINIMIZE IMAGE CARRIER WEAR

BACKGROUND OF THE INVENTION

The present invention relates to a developing device for applying a developer to the latent image formed on an image carrier. More particularly, the invention relates to a developing roller for applying a developer, while held in contact with a surface of an image carrier that is shaped like a belt.

Image forming apparatuses such as printers and copiers are known, each having a pair of rollers and a photosensitive belt wrapped around the rollers. In an image forming apparatus of this type, an electrostatic latent image is formed on a surface of the photosensitive belt. A developer is applied onto the surface of the belt, thereby developing the electrostatic latent image into a developer image. The developer image is transferred onto a recording paper sheet and then fixed. An image is thereby formed on the recording paper sheet.

The image forming apparatus has a developing device designed to develop the electrostatic latent image on the recording paper sheet. The developing device has a developing roller for applying the developer onto the surface of the photosensitive belt. The developing roller is positioned, with its circumferential surface contacting the surface of the photosensitive belt. In operation, the developing roller is rotated in the same direction as the belt is driven and at a speed a little higher than the belt is driven. Therefore, the developing roller slides on the photosensitive belt.

The developing roller is mirror-surfaced at both end portions. The middle portion of the developing roller has a circumferential surface that is roughened to hold the developer. Thus, the developing roller can hold the developer on its middle portion, with its end portions pressed onto the surface of the photosensitive belt and thus kept clear of the developer. The developer on the middle portion of the developing roller never flows to the end portions or fall from therefrom in drops.

As the developing roller slides on the photosensitive belt, however, those parts of the belt which contact the mirror-surfaced end portions may be worn. This is because nothing acts as lubricant between the belt and the end portions of the developing roller and a prominent friction occurs between the belt and the end portions. Note that the developer works as lubricant between the belt and the middle portion of the developing roller.

The photosensitive belt comprises an endless, thin metal band and a photosensitive coating provided on one surface of the metal band. The developing roller applies the developer to the photosensitive belt, while a developing bias voltage is being applied between the belt and the developing roller. If the photosensitive coating is scraped, the metal band will be exposed and a leakage current will flow. The leakage current may damage the photosensitive belt.

BRIEF SUMMARY OF THE INVENTION

The present invention has been made in view of the foregoing. The object of the invention is to provide a developing roller and a developing device, which can minimize wear of an image carrier that remains in frictional contact with the developing roller, thereby increasing the lifetime of the image carrier.

To achieve the object, a developing roller according to the invention has an outer circumferential surface for holding a developer and designed to rotate apply the developer to a belt-shaped image carrier while rotating with the circumferential surface set in frictional contact with the image carrier. The developing roller comprises: two developer-non-retaining parts provided near the ends of the roller, for retaining no developer; a developer-retaining part extending between the two developer-non-retaining parts, for retaining the developer; and spacer means for preventing the image carrier from coming to frictional contact with the two developer-non-retaining parts.

A developing device according to the invention comprises: a reservoir containing a developer; a developing roller having an outer circumferential surface for holding a developer and designed to rotate apply the developer to a belt-shaped image carrier while rotating with the outer circumferential surface set in frictional contact with the image carrier; a developer-applying section for applying the developer from the reservoir to the outer circumferential surface of the developing roller. The developing roller comprises: two developer-non-retaining parts provided near the ends of the roller, for retaining no developer; a developer-retaining part extending between the two developer-non-retaining parts, for retaining the developer; and spacer means for preventing the image carrier from coming into frictional contact with the two developer-non-retaining parts.

DETAILED DESCRIPTION OF THE INVENTION

Embodiments of the present invention will be described, with reference to the accompanying drawings.

Figure 1:
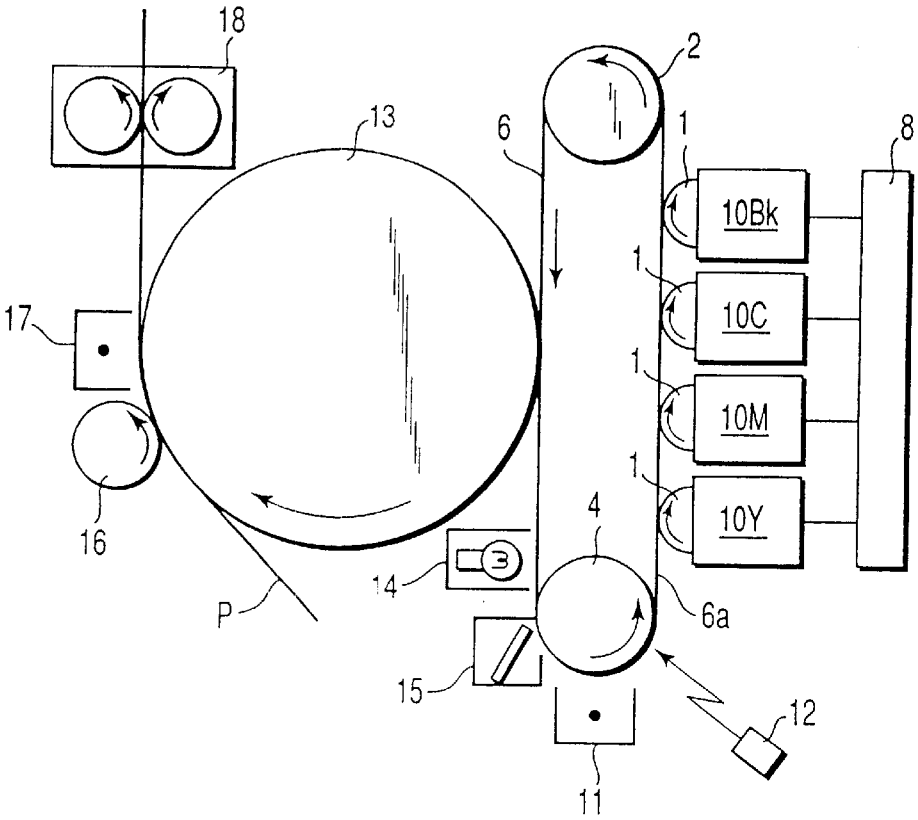
FIG. 1 is a schematic representation of a full-color copier.

FIG. 1 is a schematic representation of a full-color copier to which this invention is applied.

The copier has a driving roller 2, a driven roller 4, and an endless photosensitive belt 6 (i.e., image carrier). The rollers 2 and 4 extend parallel to each other and spaced one above the other. The photosensitive belt 6 is wrapped around the driving roller 2 and the driven roller 4. The belt 6 is driven at a constant speed in the direction of an arrow when the driven roller 2 rotates at the constant speed in the direction of another arrow shown in FIG. 1. The belt 6 comprises a thin metal band, a photosensitive layer provided on the metal band, and a photosensitive coating provided on the photosensitive layer.

The full-color copier further has a charging device 11, an exposure device 12, four developing devices 10Y, 10M, 10C and 10Bk, an intermediate transfer body 13, a de-charging device 14, and a cleaning device 15. The devices 11 and 12, transfer body 13 and devices 14 and 15 are arranged along the belt 6, or in the direction the belt 6 is driven, in the order they are mentioned. In operation, the charging device 11 electrically charges the surface 6*a* of the belt 6 to a predetermined potential. The exposure device 12 applies the light beam to the surface 6*a* of the belt 6, thereby forming latent images of different colors on the surface 6*a*. The developing devices 10Y, 10M, 10C and 10Bk, which may hereinafter be referred to as "developing devices 10", apply one-component developers (hereinafter referred to as "toners") of different colors to the latent images formed on the surface 6*a* of the belt 6. Thus, the devices 10Y, 10M, 10C and 10Bk develop the latent images, forming visible images (toner images) of different colors. The visible images are transferred from the belt 6 to the intermediate transfer body 13. On the surface of the body 13, the visible images overlap one upon another. The de-charging device 14 removes the residual electric charge from the surface 6*a* of the photosensitive belt 6. The cleaning device removes the toners remaining on the surface 6*a* of the belt 6, not transferred onto the intermediate transfer body 13.

The developing devices 10Y, 10M, 10C and 10Bk are spaced apart at regular intervals, in the direction of driving the photosensitive belt 6. The developing devices 10Y, 10M, 10C and 10Bk can be independently moved to contact and leave the photosensitive belt 6, by means of a drive mechanism 8. The devices 10Y, 10M, 10C and 10Bk have one developing roller 1 each. The developing roller 1 is designed to apply toner to the surface 6*a* of the belt 6, as will be later described in detail.

The drive mechanism 8 drives each developing device 10 from a non-operating position to an operating position. At the operating position, the developing roller 1 contacts, at its outer circumferential surface 1*a*, the photosensitive belt 6, pushing the belt 6 for a preset distance of about 0.5 mm. Thus, the belt 6 is displaced from its running course, but by a relatively short distance.

While remaining at the non-operating position, each developing device 10 has its developing roller 1 stays out of contact with the surface 6*a* of the photosensitive belt 6.

While located at the operating position, the developing roller 1 of each developing device 10 is rotated in the direction of arrow (FIG. 1) at a circumferential speed a higher than the photosensitive belt 6 is driven. In the present embodiment, the circumferential speed of the roller 1 is 1.2 to 2 times as high as the speed of the belt 6. Therefore, the developing roller 1 slides on the photosensitive belt 6.

The intermediate transfer body 13 is located, facing the developing devices 10 across the photosensitive belt 6. The body 13 is placed in rotating contact with the surface 6*a* of the photosensitive belt 6. The intermediate transfer body 13 is rotated in the same direction (see arrow in FIG. 1) as the belt 6 is driven, at a circumferential speed equal to the speed of the belt 6.

A feed roller 16 and a transfer device 17 are provided, facing the belt 6 across the intermediate transfer body 13. The feed roller 16 is in rotating contact with the body 13, for feeding a recording paper sheet P along the circumference of the body 13. The transfer device 17 is designed to transfer a color toner image from the body 13 to the recording paper sheet P.

A fixing device 18 is arranged at the downstream of the transfer device 17 (or located above the device 17, as is illustrated in FIG. 1). The fixing device 18 is designed to press and heat the paper sheet P, thereby fixing the color toner image transferred to the paper sheet P by the transfer device 17.

The full-color copier thus constructed operates as will be described below.

A document sheet is placed on the document table (not shown). When the user pushes the copy button (not shown), the charging device 11 electrically charges the surface 6*a* of the belt 6 uniformly to a predetermined potential. The exposure device 12 generates a light beam from a yellow-image signal that has been generated by color-decomposing the light reflected from the document sheet. The laser beam is applied to the surface 6*a* of the photosensitive belt 6. A yellow latent image is thereby formed on the surface 6*a* of the belt 6.

Meanwhile, the drive mechanism 8 drives the developing device 10Y for developing a yellow latent image, to the operating position shown in FIG. 1. The other developing devices 10M, 10C and 10Bk for developing latent images of other colors are held at non-operating positions, not contacting the photosensitive belt 6.

The developing device 10Y applies yellow toner to the photosensitive belt 6. The electrostatic latent image on the surface 6*a* of belt 6 is thereby developed, forming a yellow toner image. As the photosensitive belt 6 is driven, the yellow toner image is brought to the intermediate transfer body 13. The yellow toner image is transferred from the belt 6 to the body 13, by virtue of the bias voltage applied between the belt 6 and the body 13.

Thereafter, the de-charging device 14 applies light to the surface 6*a* of the photosensitive belt 6, thereby removing the residual electric charge from the surface 6*a* of the belt 6. Then, the cleaning device 15 removes the toners remaining on the surface 6*a* of the belt 6, not transferred onto the intermediate transfer body 13.

Next, a magenta latent image is formed on the surface 6*a* of the photosensitive belt 6. More precisely, the charging device 11 electrically charges the surface 6*a* of the belt 6 uniformly to a predetermined potential. The drive mechanism 8 drives the developing device 10M for developing a magenta latent image, to the operating position, and drives the other developing devices 10Y, 10C and 10Bk to the non-operating positions. In this condition, the above-mentioned sequence of process, i.e., exposure, developing and image transfer to the intermediate transfer body 13, is performed. A magenta toner image is thereby transferred to the outer circumferential surface of the intermediate transfer body 13, overlapping the yellow toner image. After the magenta toner image is thus transferred, a cyan toner image and a black toner image are transferred, each overlapping the images already transferred.

All toner images of different colors, overlapping on the intermediate transfer body 13, is moved as the intermediate transfer body 13 is rotated. They pass through a transfer region. In the transfer region, the transfer device 17 transfers the toner images from the body 13 to the recording paper sheet P that is passing through the transfer region.

The paper sheet P, with the toner images of different colors on it, is fed to the fixing device 18. The fixing device 18 applies pressure and heat to the paper sheet P, fixing toner images on the paper sheet P. Thus, a full-color image is formed on the recording paper sheet P.

Figure 2:
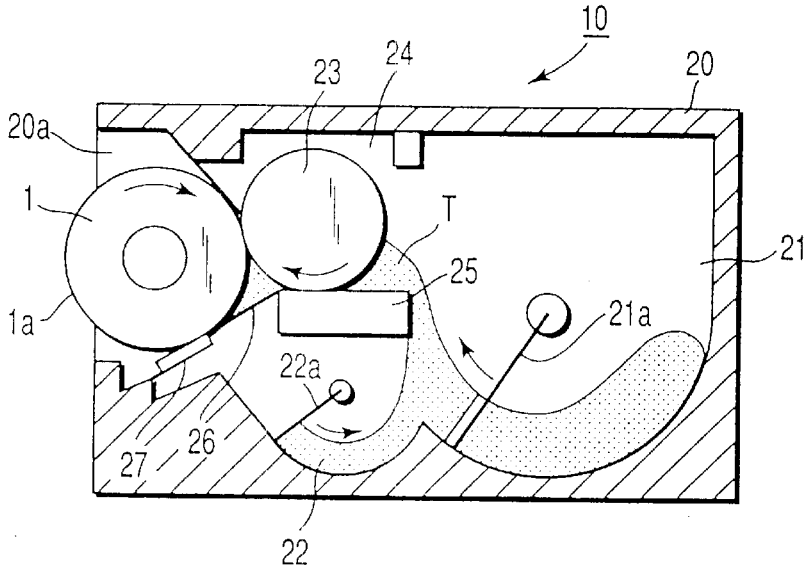
FIG. 2 is a sectional view of one of the developing devices provided in the copier of FIG. 1 (i.e., the first embodiment of the invention), which are identical in structure.

FIG. 2 is a sectional view of one of the developing devices 10. The developing devices have the same structure; they differ only in the color of toner T each uses. Thus, only one developing device 10 is shown in FIG. 2 and will be described. As described above, the developing device 10 can be brought into contact with the photosensitive belt 6 and moved away therefrom by means of the drive mechanism 8, independently of any other developing device.

The developing device 10 comprises a toner reservoir 21, a paddle 21*a*, a toner recovery chamber 22, a paddle 22*a*, a toner-applying roller 23, a toner-applying chamber 24, a partition 25, a developing roller 1, a sheet 26, and a blade 27. The reservoir 21 stores toner T. The paddle 21*a* is provided in the reservoir 21, for stirring the toner T and applying the same to the roller 23 as it is rotated in the direction of the arrow. The toner recovery chamber 22 is located at the left of the toner reservoir 21. The paddle 22*a* can rotate in the direction of the arrow shown in FIG. 2, to supply the toner T back into the toner reservoir 21 from the toner recovery chamber 22. The toner-applying roller 23 is made of electrically conductive foam rubber. The roller 23 is provided in the toner-applying chamber 24 and positioned above the toner recovery chamber 22. The partition 25 horizontally extends, partitioning the toner-applying chamber 24 from the toner recovery chamber 22. The developing roller 1 is positioned at the left side of the toner-applying roller 23 and set in rotating contact therewith. A sheet 26 extends slantwise, arranged below the rotating-contact between the developing roller 1 and the toner-applying roller 23. The blade 27 is located near the sheet 26 and held in contact with the circumferential surface of the developing roller 1.

The blade 27 comprises a leaf spring and a urethane-rubber strip. The strip is adhered to the distal end of the leaf spring. The leaf spring apples a bias to the urethane rubber strip. The urethane-rubber strip is thereby set in friction with the circumferential surface la of the developing roller 1. When the developing roller 1 is rotated, the friction between the strip and the roller 1 generates static electricity. The toner T applied to the roller 1 along the sheet 26 as the toner-applying roller 23 rotates is therefore electrically charged to the prescribed potential. The toner T forms a layer on the circumferential surface of the developing roller 1, to a thickness that is equal to the gap between the developing roller 1 and urethane-rubber strip. In this embodiment, the pressure the blade 27 applies to the developing roller 1 is 50 to 150 g/cm$^2$, the toner T layer is applied to the roller 1 at rate of 200 to 800 $\mu$g/cm$^2$ and the toner T is electrically charged to 15 to 40 $\mu$C/g, in order to form images of good quality.

The developing device 10 has an almost rectangular housing 20. The housing 20 has an opening 20*a*, which exposes a part of the circumferential surface of the developing roller 1.

In the toner reservoir 21, the paddle 21*a* is rotated, stirring and supplying the toner T into the toner-applying chamber 24 that is located above the partition 25. In the toner-applying chamber 24, the toner-applying roller 23 forces the toner T toward the developing roller 1. The toner T, thus applied, moves along the sheet 26 to the blade 27. As the roller 1 rotates, the toner T is applied to the photosensitive belt 6 in the form of a layer having a uniform thickness, while being electrically charged to the prescribed potential by means of the blade 27. The excessive part of the toner T, which has been removed by the blade 27, is collected into the toner recovery chamber 22 and supplied thence back into the toner reservoir 21 as the paddle 22*a* rotates.

Figure 3A:
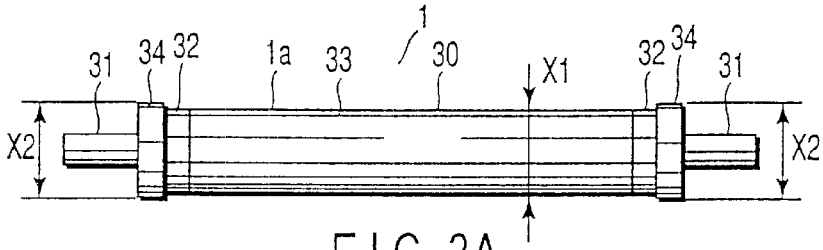
FIG. 3A is a side view of the developing roller incorporated in the developing device of FIG. 2.
Figure 3B:
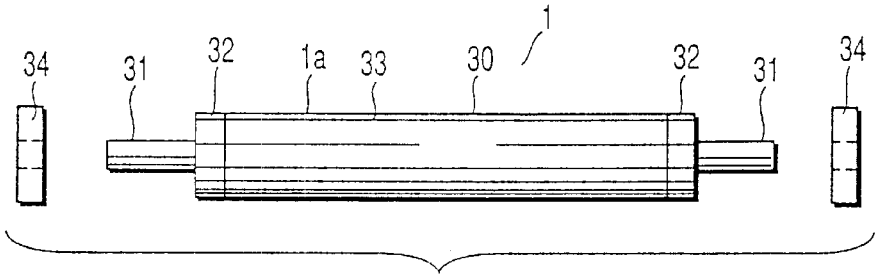
FIG. 3B is an exploded view of the roller shown in FIG. 3A.

FIG. 3A shows the developing roller 1 according to the first embodiment. FIG. 3B is an exploded view of the roller 1.

As shown in FIG. 3B, the developing roller 1 comprises a roller section 30 and a shaft 31, which are formed integral. The shaft 31 extends through the roller section 30 and is coaxial therewith. The roller section 30 is a hollow cylinder made of aluminum, which is metal easy to machine. The roller section 30 has a circumferential surface 1*a*, which consists of two mirror surfaces 32 (developer-non-retaining areas) on its ends and a rough surface 33 (developer-retaining area) on its middle part.

The rough surface 33 has been formed by means of, for example, sand blasting. It has roughness Rz (10-point average roughness) ranging from 1 $\mu$m to 4 $\mu$m and can hold a layer of toner T having an appropriate thickness. The mirror surfaces 32 have almost no roughness and cannot hold the toner T. Hence, the toner T retained on the rough surface 33 is prevented from falling from either end portion of the developing roller 1.

The hollow cylinders 34, which function as spacer means in this invention, are mounted on the shaft 31 and contact the ends of the roller section 30, respectively. The cylinders 34 are secured to the shaft 31, either having been pushed onto the shaft 31 or adhered to the shaft 31. The hollow cylinders 34 are made of such resin that they are hardly wear though the photosensitive belt 6 slides on them. They have an outer diameter X2 a little larger than that of the roller section 30. In the present embodiment, the diameter X2 is 0.01 to 0.5 mm larger than the outer diameter X1 of the developing roller 1.

Figure 4:
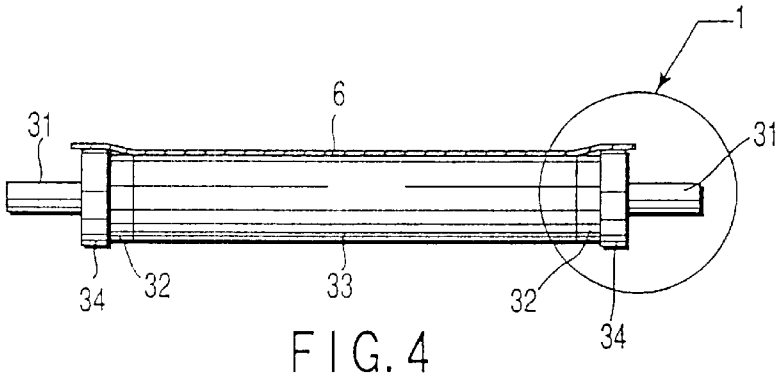
FIG. 4 shows a photosensitive belt and the developing roller of FIG. 3A pressed onto the belt.
Figure 5:
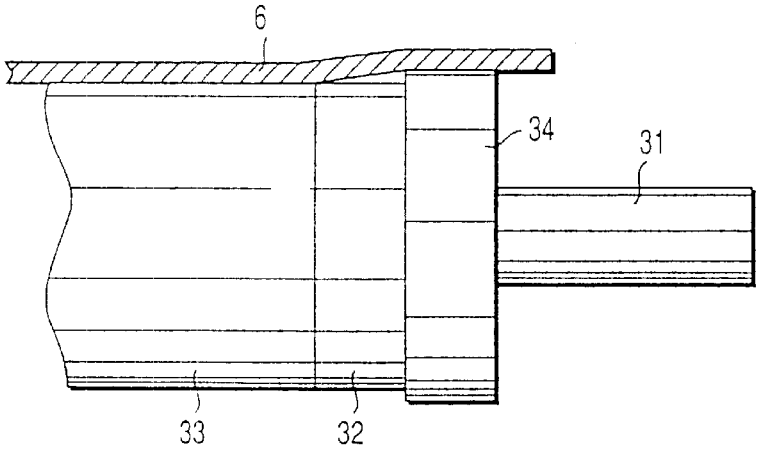
FIG. 5 is a magnified view of a part of the developing roller shown in FIG. 4.

Once the developing device 10 is driven to the operating position by the drive mechanism 8, all circumferential surface of the developing roller 1, but the mirror surfaces 32, abuts on the photosensitive belt 6 as is illustrated in FIGS. 4 and 5, because the hollow cylinders 34 have an outer diameter larger than that of the roller section 30. In other words, the hollow cylinders 34 work as spacers, reliably spacing the belt 6 away from the mirror surfaces 32. The belt 6 would no come into frictional contact with the mirror surfaces 32. Hence, the photosensitive coating of the belt 6 is never scraped, and a leakage current will not flow at all. This prolongs the lifetime of the photosensitive belt 6.

To space the belt 6 from the mirror surface 32 appropriately, the difference in outer diameter between the developing roller 1 and each hollow cylinder 34 should have an appropriate value. If the difference is less than 0.01 mm, the hollow cylinders 34 will fail to function as spacers, and the belt 6 may contact the mirror surfaces 32. If the difference is greater than 0.5 mm, the belt 6 will be indeed spaced from the mirror surfaces 32, but will be deformed and will likely be damaged.

The hollow cylinders 34 may come into frictional contact with the photosensitive belt 6. Nonetheless, they will not scrape the photosensitive coating of the belt 6 as much as at the mirror surfaces 32. This is because the cylinders 34 are made of resin, much softer than the roller section 30. The cylinders 34 will not scrape the photosensitive coating of the belt 6 even if they are set into frictional contact with the belt 6. The cylinders 34 may be made of polyacetal that is self-lubricating material. If this is the case, the cylinders 34 will scarcely scrape the photosensitive belt 6.

Figure 6A:
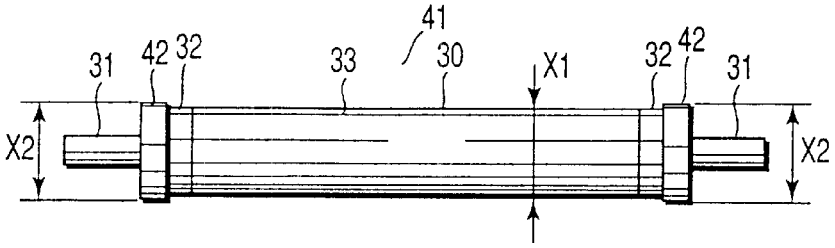
FIG. 6A is a side view of a developing roller according to the second embodiment of the invention.
Figure 6B:
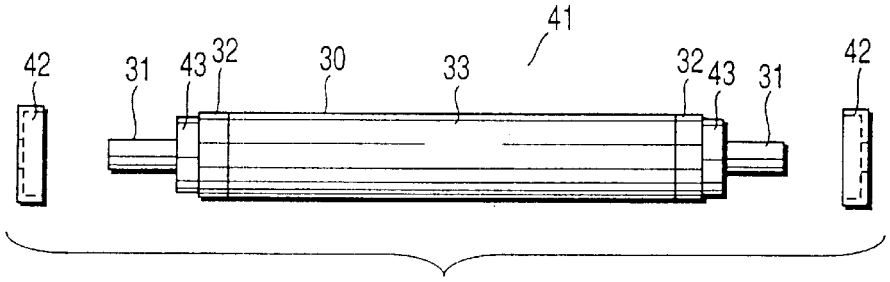
FIG. 6B is an exploded view of the roller shown in FIG. 6A.

FIG. 6A is a side view of a developing roller 41 according to the second embodiment of the invention. FIG. 6B is an exploded view of the roller 41.

The developing roller 41 has two caps 42, which have the same outer diameter X2 as the hollow cylinders 34 and are mounted on hollow cylindrical holders 43. The holders 43 are mounted on the shaft 31, contact the ends of the roller section 30 and, thus, are adjacent to the mirror surfaces 32. Unlike the hollow cylinders 34, the caps 42 are not mounted directly on the shaft 31. The caps 42 are secured to the holders 43, either having been pushed onto the holders 43 or adhered to thereto. The developing roller 41 is identical in structure to the developing roller 1 described above, except that two caps 42 and two holders 43 are used in place of the hollow cylinders 34. The components of the roller 41, which are identical to those of the roller 1, are designated at the same reference numerals in FIGS. 6A and 6B and are not described in detail.

Figure 7A:
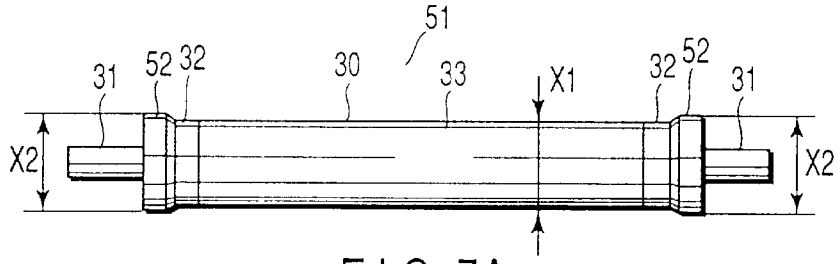
FIG. 7A is a side view of a developing roller according to the third embodiment of the invention.
Figure 7B:
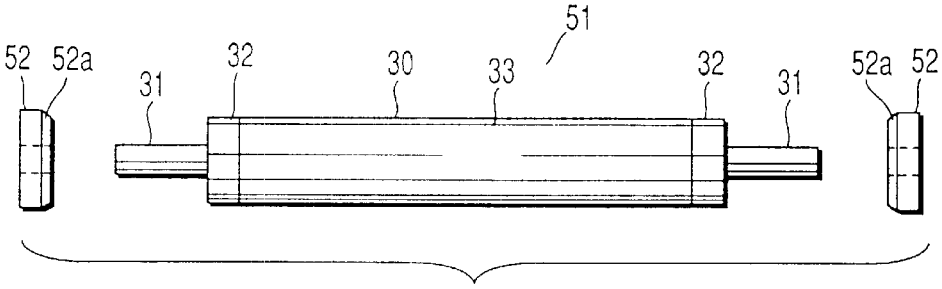
FIG. 7B is an exploded view of the roller illustrated in FIG. 7A.

FIG. 7A is a side view of a developing roller 51 according to the third embodiment of the invention. FIG. 7B is an exploded view of the roller 51.

The developing roller 51 has two hollow cylinders 52, which are substantially the same in shape as the hollow cylinders 34 of the first embodiment. The hollow cylinders 52 are each chamfered at the end that abuts on the end of the mirror-surface part 32. Hence, the hollow cylinders 52 do not contact the photosensitive belt 6 at their chamfered ends. The developing roller 51 is identical in structure to the developing roller 1, except that two hollow cylinders 52 are used instead of the hollow cylinders 34. The components of the roller 51, which are identical to those of the roller 1, are designated at the same reference numerals in FIGS. 7A and 7B and are not described in detail.

Figure 8A:
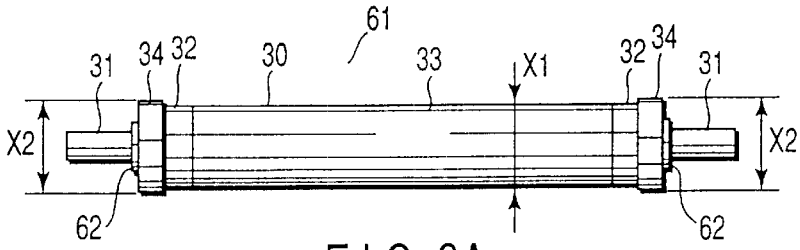
FIG. 8A is a side view of a developing roller according to the fourth embodiment of the invention.
Figure 8B:
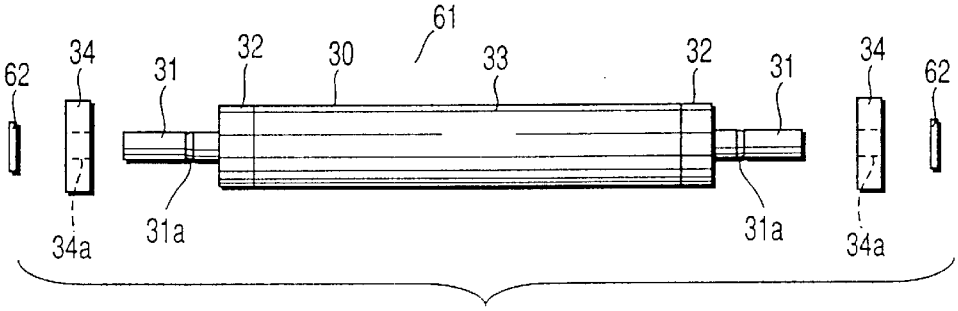
FIG. 8B is an exploded view of the roller shown in FIG. 8A.

FIG. 8A is a side view of a developing roller 61 according to the fourth embodiment of the invention. FIG. 8B is an exploded view of the roller 61.

The developing roller 61 has two hollow cylinders 34, which are identical to those of the first embodiment. Each hollow cylinder 34 has an axial hole 34*a* having a diameter a little larger than the diameter of the shaft 31. The shaft 31 has two slits 31*a* in the end portions. Two E rings 62 is fitted in the slits 31*a*, respectively, thus enabling the two hollow cylinders 34 to rotate freely. The developing roller 61 is identical in structure to the developing roller 1, except for the E rings 62 and the slits 31*a*. The components identical to those of the first embodiment are not described in detail.

The second to fourth embodiments, described above, achieve the same advantage as the first embodiment. That is, it is possible to prevent the wear of the photosensitive belt 6 that may result from the frictional contact between each mirror surface 32 and the photosensitive belt 6. This prolongs the lifetime of the photosensitive belt 6. Moreover, the wear of the belt 6 due to the frictional contact between the belt 6 and the hollow cylinders 34 or caps 43 is very small, because the cylinders 34 and caps 43 are made of polyacetal. In the fourth embodiment, the wear of the belt 6 can be prevented almost perfectly, since the hollow cylinders 34 can freely rotate on the shaft 31.

A modification 10' of the developing device according to the first embodiment will be described, with reference to FIGS. 9 to 12. The modified developing device 10' is identical in structure to the developing device 10 described above, except that the developing roller 1' has no hollow cylinder 34. The components of the device 10', which are identical to those of the roller 1, are designated at the same reference numerals in FIGS. 9 to 12, and will not be described in detail.

Figure 9:
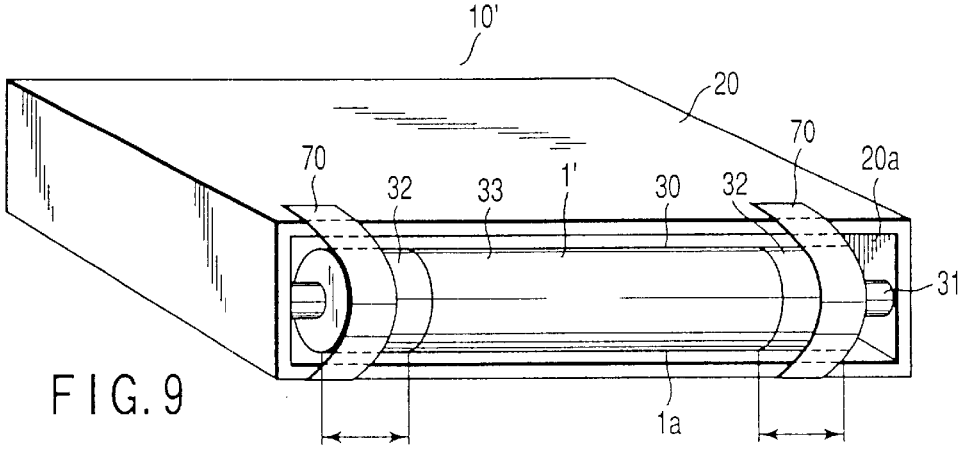
FIG. 9 is a perspective view a modified developing device according to the invention, as viewed from the side in which a developing roller is provided.
Figure 10:
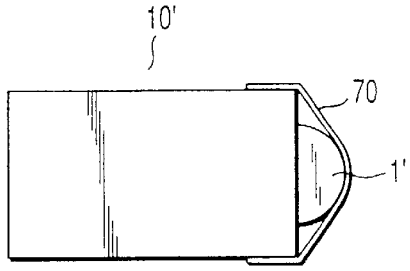
FIG. 10 is a front view of the developing device shown in FIG. 9.

The developing device 10' has a developing roller 1', which is exposed in part through an opening 20*a* made in the front of the housing 20. The roller 1' has no parts equivalent to the hollow cylinders 34 on the end portions of the shaft 31. Instead, two thin films 70 shaped like a sheet and made of plastic or resin are adhered to the housing 20 as shown in FIGS. 9 and 10, each covering the exposed part of one mirror surface of the roller 1'. The films 70 are set in sliding contact with the mirror surfaces 32 of the roller 1' and are adhered to the housing 20.

Figure 11:
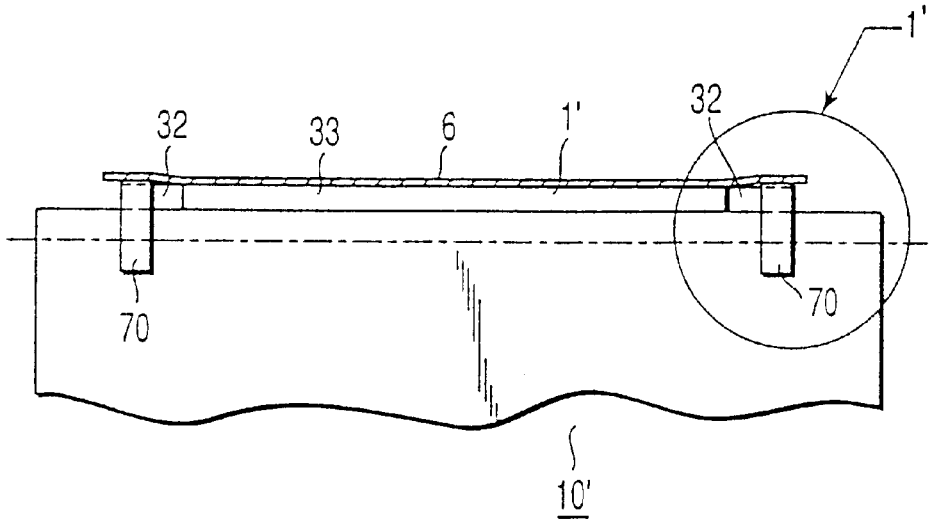
FIG. 11 is a plan view of the developing device moved to an operating position, showing the developing roller pressed onto a photosensitive belt.
Figure 12:
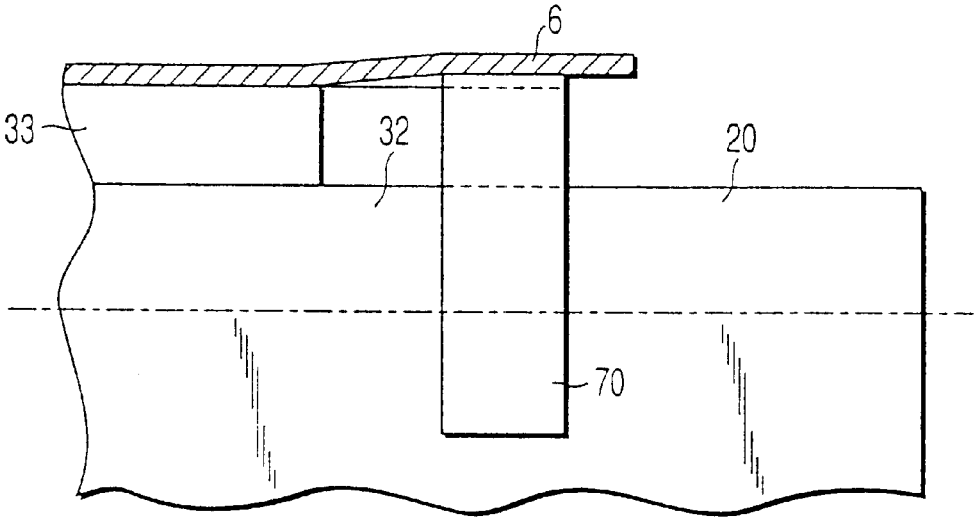
FIG. 12 is a magnified view of a part of the developing device shown in FIG. 11.

When the developing device 10' is moved to the operating position, the developing roller 1' is set into frictional contact with the photosensitive belt 6. Then, the films 70 are interposed between the photosensitive belt 6 and the mirror surfaces 32 of the roller 1' as is illustrated in FIGS. 11 and 12. The mirror surfaces 32 are thereby reliably spaced from the photosensitive belt 6. Space from the belt 6, the mirror surfaces 32 never scrapes the belt 6. Thus, a leakage current will not flow at all. This prolongs the lifetime of the photosensitive belt 6.

In order to space the mirror surfaces 32 from the belt 6 and yet set the rough surface 33 into effective frictional contact with the belt 6, the width, thickness and position of the film 70 are important. Therefore, in the modification, the films 70 are 5 to 7 mm wide and 0.05 mm to 0.25 mm thick, and each is provided at a distance of 3 to 5 mm from the boundary between the mirror surface 32 and the rough surface 33.

The films 70 remains in sliding contact with the photosensitive belt 6 while the developing device 10' is operating, and may scrape the circumferential surface of the photosensitive belt 6. Nonetheless, the films 70 would not scrape the belt 6 only a little, because they are made of plastic or resin that is much softer than the roller section 30 made of metal.

The modified developing device 10' achieves the same advantage as the first to fourth embodiments. In addition, the developing roller 1' has no hollow cylinders or caps and is therefore more simple in structure. It suffices to adhere two films 70 to the housing 20 to space the mirror surfaces 32 from the photosensitive belt 6.

The present invention is not limited to the embodiments described above. Rather, various changes modifications can be made, without departing from the scope and spirit of the invention.

What is claimed is:

1. A developing roller having an outer circumferential surface for holding a developer and designed to rotate apply the developer to a belt-shaped image carrier while rotating with the circumferential surface set in frictional contact with the image carrier, said developing roller comprising:

two developer-non-retaining parts provided near the ends of the roller, for retaining no developer;

a developer-retaining part extending between the two developer-non-retaining parts, for retaining the developer; and spacer means for preventing the image carrier from coming to frictional contact with the two developer-non-retaining parts.

2. The developing roller according to claim 1, wherein the spacer means comprises two hollow cylinders provided adjacent to outer ends of the two developer-non-retaining parts, respectively, having a larger diameter than the developer-non-retaining parts, and preventing the image carrier from coming into frictional contact with the two developer-non-retaining parts.

3. The developing roller according to claim 2, wherein the two hollow cylinders are made of resin.

4. The developing roller according to claim 3, wherein the two hollow cylinders are made of polyacetal.

5. A developing device comprising:

a reservoir containing a developer;

a developing roller having an outer circumferential surface for holding a developer and designed to rotate apply the developer to a belt-shaped image carrier while rotating with the outer circumferential surface set in frictional contact with the image carrier;

a developer-applying section for applying the developer from the reservoir to the outer circumferential surface of the developing roller, said developing roller comprising:

two developer-non-retaining parts provided near the ends of the roller, for retaining no developer;

a developer-retaining part extending between the two developer-non-retaining parts, for retaining the developer; and spacer means for preventing the image carrier from coming into frictional contact with the two developer-non-retaining parts.

6. The developing device according to claim 5, wherein the spacer means comprises two hollow cylinders provided adjacent to outer ends of the two end portions, respectively, having a larger diameter than the two developer-non-retaining parts, and preventing the image carrier from coming into frictional contact with the two developer-non-retaining parts.

7. The developing roller according to claim 6, wherein the two hollow cylinders are made of resin.

8. The developing roller according to claim 7, wherein the two hollow cylinders are made of polyacetal.

9. The developing device according to claim 5, wherein the spacer means comprises two films covering the two developer-non-retaining parts in part, respectively, each film positioned to be interposed between the image carrier and one developer-non-retaining part.

10. The developing device according to claim 9, wherein the films are made of one material selected from the group consisting of resin and plastic.

11. An image forming apparatus comprising:

a belt-shaped image carrier that is movable endlessly;

an exposing device that forms latent images by exposing a surface of the belt-shaped image carrier;

a plurality of developing devices for development by providing developers for the latent images formed on the surface;

each of said developing devices including: a reservoir containing a developer; a developing roller that provides the developer for the surface when the developing roller holding the developer thereon rotates, with an outer circumferential surface thereof being kept in frictional contact with the surface; and a developer-applying section for applying the developer from the reservoir to the outer circumferential surface of the developing roller;

the developing roller having: two developer-non-retaining parts, provided near axial ends of the roller, for retaining no developer; a developer-retaining part, located between the two developer-non-retaining parts, for retaining the developer; and a spacer for preventing the surface of the image carrier from coming into frictional contact with the two developer-non-retaining parts; and a drive mechanism that presses the outer circumferential surface of the developing roller of each of the developing devices against the surface of the belt-shaped image carrier while one of the developing devices is selectively brought into contact with the belt-shaped image carrier, whereby when the outer circumferential surface is pressed against the surface of the belt-shaped image carrier, the spacers serve to keep the two developer-non-retaining parts away from the surface of the belt-shaped image carrier.

* * * * *